US005485501A

United States Patent [19]

Aichinger

[11] Patent Number: 5,485,501

[45] Date of Patent: Jan. 16, 1996

[54] METHOD FOR THE OPERATION OF AN AUTOMATIC X-RAY EXPOSURE UNIT

[75] Inventor: Horst Aichinger, Fuerth, Germany

[73] Assignee: Siemens Aktiengesellschaft, Munich, Germany

[21] Appl. No.: 288,043

[22] Filed: Aug. 10, 1994

[30] Foreign Application Priority Data

Sep. 10, 1993 [DE] Germany ..... 43 30 787.6

[51] Int. Cl.[6] ..... H05G 1/64

[52] U.S. Cl. ..... 378/98.7; 378/96; 378/98.11; 378/98.12

[58] Field of Search ..... 379/98.11, 37, 379/98.12, 98.9, 98.7, 96, 97, 108, 110, 112, 207

[56] References Cited

U.S. PATENT DOCUMENTS

| | | | |
|---|---|---|---|
| 5,003,571 | 3/1991 | Kido et al. | 378/37 |
| 5,148,460 | 9/1992 | Aichinger | 378/108 |
| 5,289,520 | 2/1994 | Pellegrino | 378/37 |
| 5,315,631 | 5/1994 | Hillen et al. . | |

OTHER PUBLICATIONS

"Untersuchungen über den Einfluss des Strahlemreliefs auf die mittlere Filmschwärzung—eine bei Belichtungsautomaten auftretende Fragestellung," Widenmann et al., Röntgem–Blätter, vol. 15, No. 4, Apr., 1962, pp. 97–107 (no translation).

*Primary Examiner*—David P. Porta
*Assistant Examiner*—Don Wong
*Attorney, Agent, or Firm*—Hill, Steadman & Simpson

[57] ABSTRACT

An x-ray examination installation includes an x-ray source for irradiating an examination subject with x-rays, and an automatic exposure unit having a radiation detector composed of a matrix of detector elements. Only the output signals of specified detector elements, which define the measuring field within which an optimum exposure should ensue, are utilized for generating a signal which is then supplied to the x-ray source for controlling the exposure dose. The automatic exposure unit is operated according to a method wherein a distribution of the grayscale values in a test image is first calculated, and subsequently the main image is produced with the previously-calculated distribution of grayscale values superimposed in the main image.

2 Claims, 2 Drawing Sheets

METHOD FOR THE OPERATION OF AN AUTOMATIC X-RAY EXPOSURE UNIT

BACKGROUND OF THE INVENTION

1. Field of the Invention

The present invention is directed to a method for operating an automatic x-ray exposure unit in an x-ray examination apparatus.

2. Description of the Prior Art

Automatic x-ray exposure units are known in the art which include a radiation detector composed of a matrix of detector elements. The automatic x-ray exposure unit functions to provide a signal which is supplied to the x-ray source, or more specifically to the high-voltage unit which operates the x-ray source, in order to adjust or set the exposure dose. Only the output signals of specific detector elements in the automatic exposure unit, which define the measuring field within which an optimum exposure should ensue, are utilized to generate the control signal which is used to set or adjust the exposure dose.

SUMMARY OF THE INVENTION

It is an object of the present invention to provide a method for operating an automatic x-ray exposure unit of the type described above wherein an automatic selection of the measuring field takes place.

The above object is achieved in accordance with the principles of the present invention in a method wherein, during a first time span, a first dose pulse is activated by the high-voltage generator which controls the x-ray tube by selecting an x-ray tube voltage suitable for the particular medical inquiry, this dose pulse being dimensioned so that it is insufficient for a complete exposure, even for the smallest subject density which is present in the examination subject. In a subsequent, second time span, image data, produced using the aforementioned dose pulse, are serially read out from the radiation detector and are stored in a first image memory. An image processor (computer) calculates a grayscale value distribution using the data in the first image memory. In a subsequent, third time span, the main or primary image is produced and is entered into a second image memory, with the image in the first image memory being superimposed thereon, by addition thereto.

DESCRIPTION OF THE PREFERRED EMBODIMENTS

Figure 1:
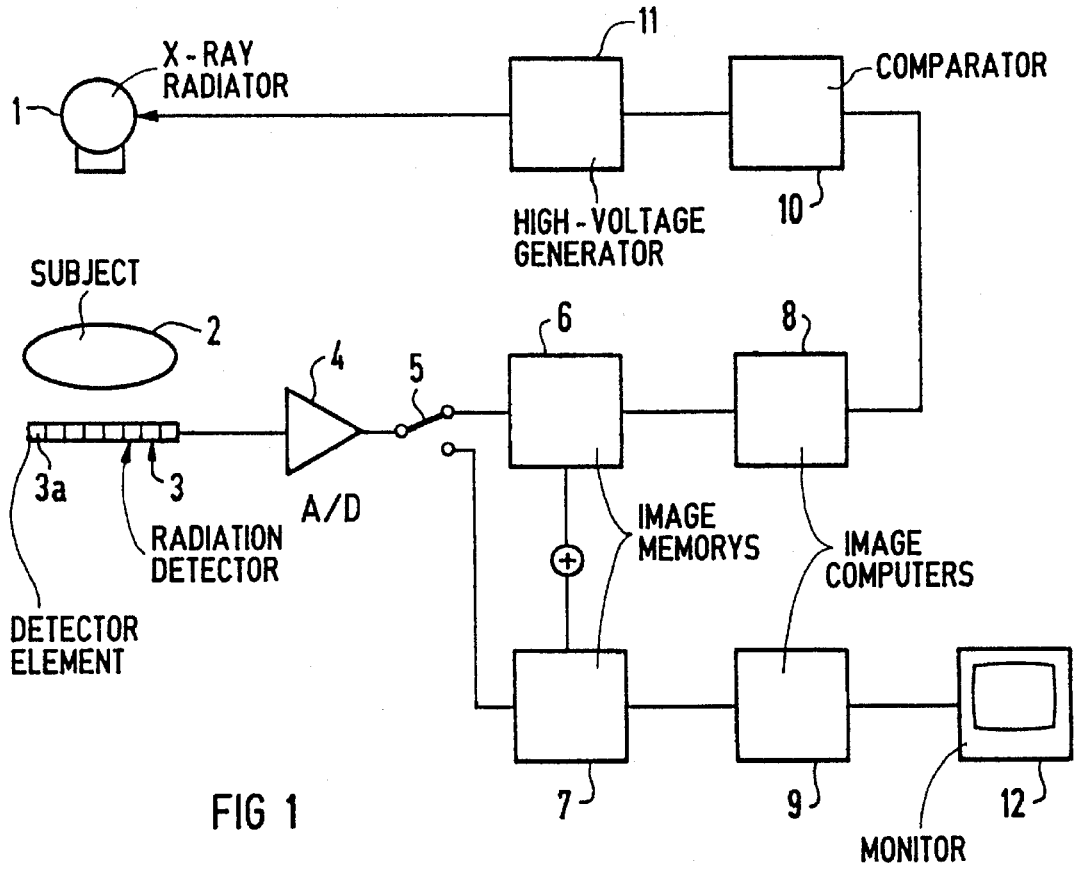
FIG. 1 is a block circuit diagram of an x-ray diagnostics installation including an automatic x-ray exposure unit constructed in accordance with the principles of the present invention.

An x-ray diagnostics installation is shown in FIG. 1 which includes an x-ray radiator 1 which transirradiates an examination subject 2 with x-rays, the x-rays emerging from the subject 2 being incident on a radiation detector 3, composed of a matrix of detector elements, one of which is referenced 3*a*. The radiation detector 3 can form the image sensor of an x-ray image generating means, particularly a video chain. The output signals of the detector elements 3*a* are optionally supplied to an image memory 6 or to an image memory 7 via an analog-to-digital converter 4 and a switch 5. The image memories 6 and 7 have respective image computers 8 and 9 allocated thereto. The image computer 8 controls the high-voltage generator 11 for the x-ray radiator 1 through a comparator 10. The image calculated in the image computer 9 is displayed on a monitor 12.

Automatic selection of the measuring field in accordance with the inventive method ensues as follows.

During a time span $t_1$ (FIG. 2), a first, short dose pulse $\overline{D}_1$ is caused to be produced by the x-ray radiator 1, by the activation thereof by the high-voltage generator 11, based on the selection of the tube voltage suitable for the particular medical inquiry of the examination. The dose pulse $\overline{D}_1$ is dimensioned such that it is insufficient to achieve a complete exposure, even given the smallest subject thickness (density) which occurs (for example, 1 cm in mammography). The relationship $\overline{D}_1 \leqq D_{ref}$ is valid in the image plane, wherein $D_{ref}$ is a reference or comparison voltage.

Figure 2:
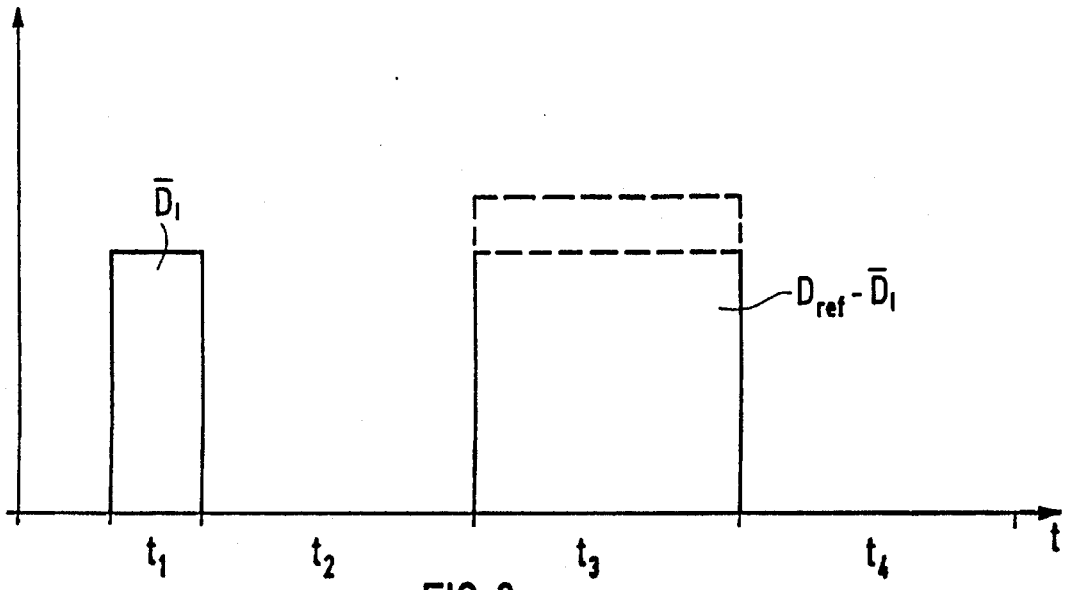
FIG. 2 illustrates the radiation pulses which are employed in accordance with the inventive method.
Figure 3:
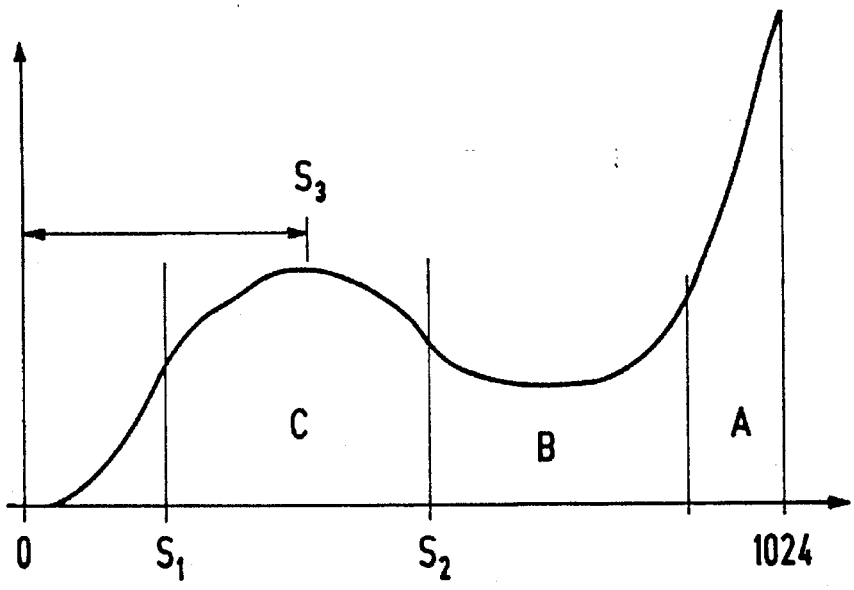
FIG. 3 illustrates a distribution of grayscale values calculated for operating the automatic x-ray exposure unit in accordance with the principles of the present invention.

Next, during the time span $t_2$ shown in FIG. 2, the image data are serially read out from the detector 3 into the image memory 6 via the analog-to-digital converter 4 (having a bit depth, or resolution, of, for example, 10 bits=1024 grayscale values/pixels). The image computer 8 calculates the distribution of the grayscale values and generates a histogram as shown in FIG. 3, representing the frequency of occurrence of each grayscale value in the grayscale (for example, 1 . . . 1024). The range A of grayscale values corresponds to the image region of the detector 3 on which x-rays are directly incident, i.e., without passing through the examination subject. The range B corresponds to the region of fatty tissue in the subject, and the range C between the thresholds $S_1$ and $S_2$ corresponds to the region of dense glandular parenchyma in the subject. This is the organ region which is important for the diagnosis, and is thus the image region which must be optimally irradiated. All detector elements in the matrix of the detector 3 which supplies signals (grayscale values) in the region between $S_1$ and $S_2$ belong to the measuring field. These detector elements, therefore, need not necessarily be contiguous. The average grayscale value is defined over the region C. This is proportional to the imaging dose $\overline{D}_1$ in the image region C (FIG. 4) applied during the time span $t_1$. The imaging dose yet to be activated by the high-voltage generator 11 in the time span $t_3$ is defined during the time span $t_2$ On the basis of a comparison of the reference dose $D_{ref}$ to the imaging dose $\overline{D}_1$, i.e., $D_{ref}-\overline{D}_1$.

Figure 4:
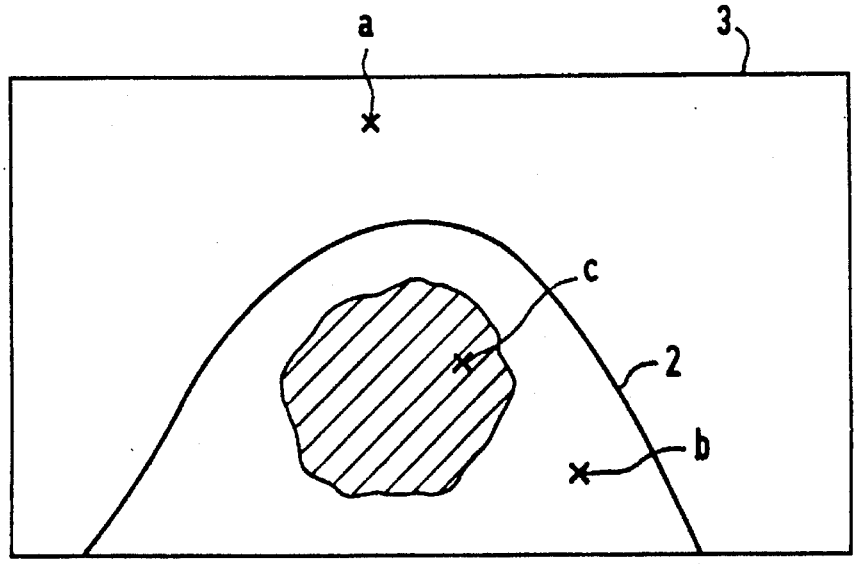
FIG. 4 shows a plan view of the radiation detector in the x-ray diagnostics installation of FIG. 1.

The detector 3 is shown in a plan view in FIG. 4, i.e., its surface is visible. Those image regions which correspond to the ranges A, B and C in FIG. 3 are designated with the letters a, b and c. The subject 2 is also shown in plan view which, in this example, is a breast.

In a third step, during the time span $t_3$, the dose $D_{ref}-\overline{D}_1$ is formed by the high-voltage generator 11 suitably activating the x-ray radiator 1, and the main or primary image is then exposed and the resulting detector signals are entered into the image memory 7 in the time span $t_4$, and the test image from the image memory 6 is added thereto. The entire, applied dose is thus used for the imaging. The dose which is caused by the automatic exposure unit to be employed for generating the main image is thus dependent on the density and on the thickness of the glandular parenchyma. The different measuring fields which arise from patient to patient must, of course, be subjected to a norming relative to a norm area, for example, corresponding to a standard measuring field size.

In FIG. 3, thus, a "test image" is formed in the time $t_1$, the dose value $D_{ref}-\overline{D}_1$ is formed in the time $t_2$, and a "main image" is formed in the time $t_3$. The read-out and the image processing ensue in the time $t_4$. The dashed lines in the time span $t_3$ are intended to illustrate the adaptation of the tube voltage to the subject transparency.

The position of the frequency maximum $S_3$ in the histogram is dependent on the density of the subject 2 itself, and on the selected tube voltage. Dependent on $S_3$, the x-ray beam quality (for example, tube voltage, filtering, etc. ) can be additionally optimized for production of the "main image" in the time span $t_3$.

If no pronounced maximum in the histogram arises, such as may be the case in a mammary containing a large amount of fatty tissue (without dense glandular parenchyma), so that the region between $S_1$ and $S_2$ cannot be calculated with certainty in the image processing, the aforementioned standard measuring field can be utilized for calculating $\overline{D}_1$.

The detector 3 can also serve as the image sensor for generation of the displayed image.

Although modifications and changes may be suggested by those skilled in the art, it is the intention of the inventor to embody within the patent warranted hereon all changes and modifications as reasonably and properly come within the scope of his contribution to the art.

I claim as my invention:

1. A method for operating an automatic x-ray exposure unit having a radiation detector composed of a matrix of detector elements, comprising the steps of:

selecting a predetermined dose which produces a complete exposure at said radiation detector of an examination subject;

during a first time span, activating an x-ray source to emit a first dose pulse by selective adjustment of an x-ray source voltage for dimensioning said first dose pulse so as to be insufficient for generating a complete exposure even with a smallest density of said subject;

during a second time span following said first time span, serially reading out image data from said radiation detector generated as a result of said first dose pulse and storing said image data in a first image memory;

calculating a grayscale value frequency of occurrence distribution of the image data in said first image memory; and during a third time span following said second time span, generating a primary image of an examination subject dependent on said distribution and storing said primary image in a second image memory, and adding said image in said first image memory to said image in said second image memory to produce a final image.

2. A method as claimed in claim 1 comprising the additional step of generating a displayable image corresponding to said final image exclusively using said radiation detector.

* * * * *